United States Patent [19]

Bullard et al.

[11] 4,028,654

[45] June 7, 1977

[54] BATTERY CHARGER

[75] Inventors: Robert G. Bullard, Odell; James P. Plunkett, W. Dundee; George F. Linning, Des Plaines, all of Ill.

[73] Assignee: Coils, Inc., Huntley, Ill.

[22] Filed: Jan. 7, 1976

[21] Appl. No.: 646,952

Related U.S. Application Data

[63] Continuation-in-part of Ser. No. 409,958, Oct. 26, 1973, abandoned.

[52] U.S. Cl. ..... 336/92; 336/107; 336/192; 339/210 R

[51] Int. Cl.[2] ..... H01F 15/10

[58] Field of Search ..... 336/90, 92, 192, 105; 336/107; 320/2; 321/8; 339/210 R, 210 M, 210 T, 206 R, 206 L, 206 P, 208

[56] References Cited

UNITED STATES PATENTS

| | | | |
|---|---|---|---|
| 2,922,932 | 1/1960 | Glowacki et al. | 336/192 X |
| 3,237,079 | 2/1966 | Mas | 336/107 X |
| 3,371,302 | 2/1968 | Mas | 336/92 |
| 3,387,244 | 6/1968 | Davis | 336/107 X |
| 3,403,366 | 9/1968 | Klatte et al. | 336/107 X |
| 3,711,806 | 1/1973 | Flentge | 336/92 |

*Primary Examiner*—Thomas J. Kozma
*Attorney, Agent, or Firm*—Dressler, Goldsmith, Clement, Gordon & Shore, Ltd.

[57] ABSTRACT

A battery charger or voltage-reducing power pack is disclosed herein. A molded bobbin, which forms part of the power pack has a mounting head which has elongated slots that receive plug-in prongs with cooperating means between the mounting head and the prongs to prevent endwise movement of the prongs with respect to the slots after insertion therein. The mounting head and base plate have unique interlocking means that cover the exposed edges of the slots to retain the prongs in the slots and also has sturdy interlocking formations to rigidly hold the bobbin with respect to the base plate after assembly.

10 Claims, 6 Drawing Figures

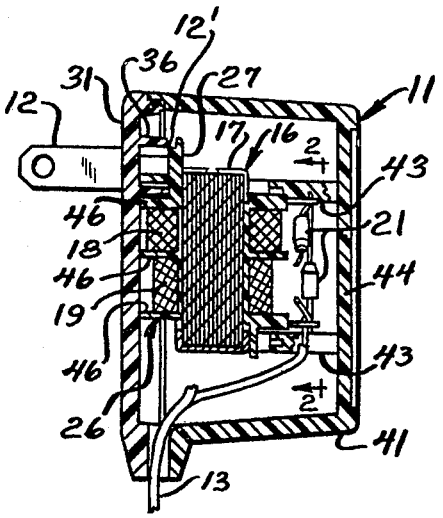
Fig. 1
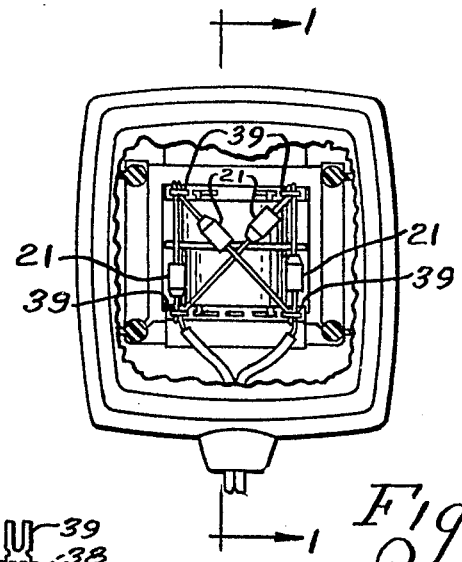
Fig. 2
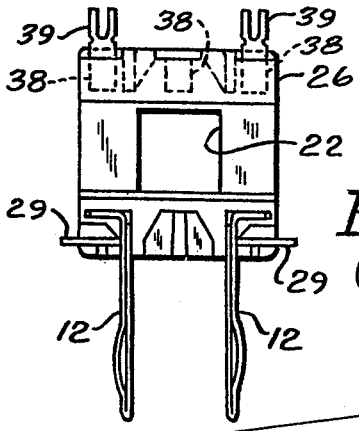
Fig. 4
Fig. 3.
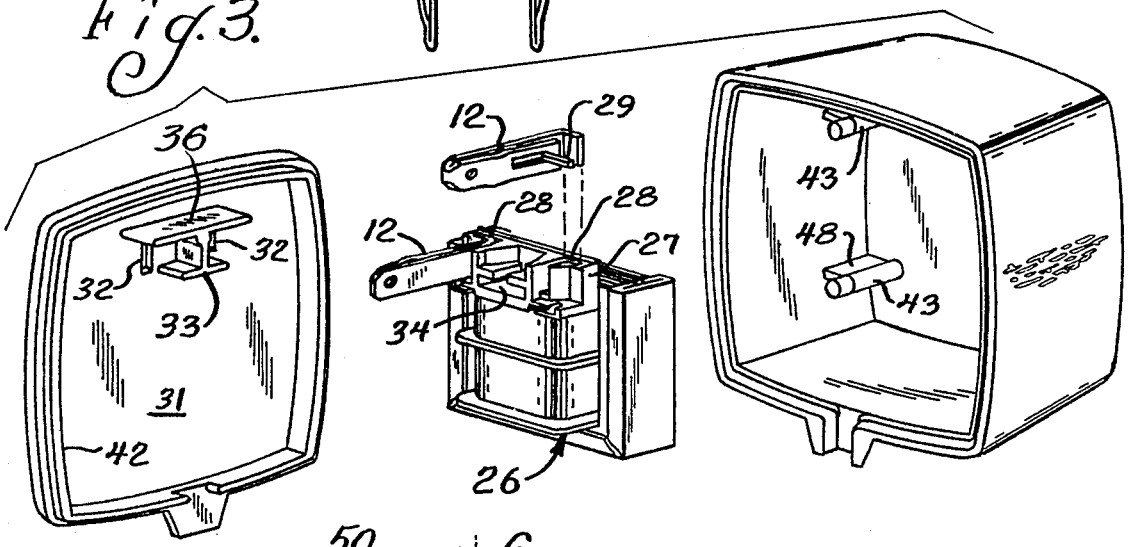
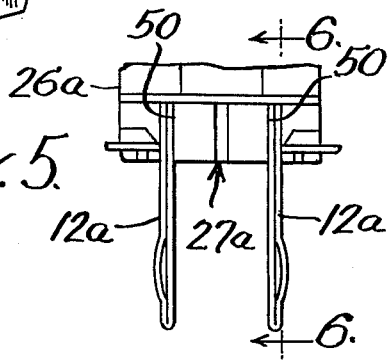
Fig. 5.
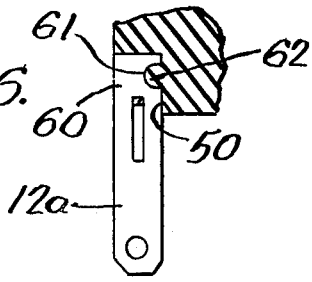
Fig. 6.

BATTERY CHARGER

REFERENCE TO RELATED APPLICATION

This application is a continuation-in-part application of Ser. No. 409,958, filed Oct. 26, 1973, now abandoned.

BACKGROUND OF THE INVENTION

The present invention relates generally to charging units or battery chargers and more particularly to voltage-reducing power packs.

Small battery chargers have been used in increasing numbers in recent years, as hand-held tools and appliances using small rechargeable batteries have become more common. Their economical manufacture with sturdy trouble-free characteristics has presented problems.

These voltage-reducing units generally include a transformer housed within a casing with a primary winding having input leads and a secondary winding having output leads. The input leads are usually connected to some type of prong structure which can be inserted into the conventional electrical outlet, while the output leads are connected to a cord which can be plugged into the unit that is to be recharged.

Because of the large market for these types of units, considerable competition has been developed among manufacturers.

While such units are being offered by domestic manufacturers, many units are still being sold by foreign manufacturers. The main reason purchasers select foreign units over domestic units is the fact that the cost of the domestic unit heretofore has been substantially higher than the cost of the foreign unit. Thus, domestic manufacturers are constantly striving to develop a unit that meets all of the stringent Underwriters Laboratory test requirements and can still be manufactured at a competitive cost.

SUMMARY OF THE INVENTION

According to the present invention, several features contribute toward the production of an exceptionally sturdy battery charger or voltage-reducing power pack at a relatively low cost. One of the contributing features is the use of a molded plastic bobbin for the coils, including a mounting head with interlocking formations. Such formations, in cooperation with mating formations on the base plate of the case, hold the transformer rigid with respect to the case and the plug-in prongs are also held in a fixed position by other interlocking formations. The manner of mounting the plug-in prongs lends itself to accessibility of pins thereon for the primary coil leads. Recesses molded in the bobbin receive connector studs for the secondary winding leads, cord ends and other components.

A single form of molded base can cooperate with either of two sizes of transformers and a molded cover is of a nature permitting ready mold adaptation for accommodating the two sizes.

More specifically, the molded plastic bobbin is formed in such a fashion that the plug-in prongs can be readily inserted into slots in the mounting head and the mounting head and prongs have interlocking means that prevent endwise or longitudinal movement of the prongs with respect to the elongated slots. In addition, the base has panel means extending across the open ends of the slots to prevent edgewise movement of the prongs with respect to the slots after the bobbin has been mounted on the base plate. The base plate and bobbin, more specifically the mounting head, also have sturdy interlocking formations that telescope together as the prongs are passed through openings in the base plate so that the bobbin, prongs and base plate are held in a fixed position with respect to each other in the assembled formation.

In one embodiment of the invention, the slots in the mounting head are L-shaped and the prongs have corresponding L-shaped shanks received into the L-shaped slots to prevent the longitudinal movement of the prongs with respect to the slots. In an alternate embodiment, the slots are planar and have projections therein intermediate opposite ends with the shanks of the prongs having recesses extending from one edge thereof and receiving the respective projections during edgewise movement of the prongs into the slots. In either embodiment, once the prongs have been fully inserted into the slots, endwise or longitudinal movement of the prongs with respect to the slots is prevented.

In both embodiments illustrated, the interlocking means between the mounting head and the base plate consists of a T-shaped projection extending from the base and a corresponding T-shaped slot on the mounting head that receives the T-shaped projection so that the bobbin is fixed with respect to the base plate after assembly thereon.

BRIEF DESCRIPTION OF THE SEVERAL VIEWS OF THE DRAWINGS

FIG. 1 is a vertical sectional view taken approximately along line 1—1 of FIG. 2 of a battery charger made according to the present invention;

FIG. 2 is a view of the structure of FIG. 1 as seen from the right with most of the coverface broken away for clarity, some parts being shown in section approximately on line 2—2 of FIG. 1;

FIG. 3 is an exploded view of the structure of FIGS. 1 and 2;

FIG. 4 is a view of the bobbin as seen from the top in FIG. 1 with plug-in prongs and connector studs assembled thereon;

FIG. 5 is a fragmentary view similar to FIG. 4 showing a slightly modified form of the bobbin and plug-in prongs;

FIG. 6 is a fragmentary sectional view, as viewed along line 6—6 of FIG. 5.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the invention to the embodiments illustrated.

Small battery chargers as now known to many households comprise a "black box" or case 11 with a pair of plug-in prongs 12 extending out from it and a connecting cord extending from it at another point with a special plug at its end. The prongs of the charger are plugged into a 120 volt electrical service outlet, and the special plug on the outer end of the cord 13 is plugged into the tool or appliance between uses thereof. An essential element inside the case 11 is a transformer 16, the essential components of which are a core 17 formed of a stack of laminations, a primary coil 18 and a secondary coil 19. The primary coil 18 is connected in series between the plug-in prongs 12; and the secondary coil 19 is connected to the cord 13 through one or more circuit components such as diode rectifiers 21. The manufacturer chooses coils 18 and 19 of the current ratio number of turns to provide the desired charging voltage in the cord 13.

It has been common therefore to wind the coils 18 and 19 on a plastic bobbin (here bobbin 26) and thereafter assemble the core 17 by slipping one of its two parts through the aperture 22 of the bobbin (see FIG. 4) and clamping the other part of the core to this part, as by clamping sheath 25 (FIG. 3). The problem of mounting the transformer within the case and of making the connections to it has received considerable attention and various solutions of this problem have been used. The present solution is deemed to have advantages over those of the past.

The battery charger or voltage-reducing power pack constructed in accordance with the teachings of the invention, allows the various components that form the unit to be assembled with respect to each other by relative movement of the respective parts and the components are held in a rigid fixed position with respect to each other in the assembled condition.

According to one aspect of the present invention, the bobbin 26 is molded of one piece with a mounting head 27. The shape of the mounting head is probably best seen in the middle portion of FIG. 3. Two L-shaped slots 28 are formed in mounting head 27 to receive the matingly shaped base portions or shanks 12' of the terminal prongs 12. These are inserted edgewise into the recesses from above as indicated in FIG. 3. Thus, the portions of the shanks and the slots that extend perpendicular to prongs 12 define interlocking means between the mounting head and shanks that prevent longitudinal movement of the shanks in the elongated slots.

After prongs 12 and shanks 12' have been inserted edgewise into slots 28, each lead-in from the primary winding previously wound on the bobbin 26 is wound around an outstanding terminal pin 29 shear-formed on its corresponding plug-in prong 12, and secured thereto as by soldering. It will be noted that the outer ends of the terminal pins are fully exposed so that the pins are readily accessible for winding of the primary coil leads thereon.

According to one aspect of the present invention, the mounting head and base have interlocking formations that hold the bobbin rigid with respect to the case as well as additional cooperating means that maintain the plug-in prongs in a fixed position or interlocking relation with respect to bobbin 26.

Referring to FIG. 3 it will be noted that base plate 31 of case 11 has a pair of openings 32 that are positioned to have prongs 12 extend therethrough while the prongs are in an assembled relation in slots 28. In addition, base plate 31 has a T-shaped formation or projection 33 molded on its inner face. The base plate 31 also has a panel 36 that is integrally molded with the remainder of the base plate. Preferably, elongated flat panel or panel means 36 is integral with the lower end of T-formation 33, for a purpose that will be described later. The interlocking formations further include a T-shaped slot 34 molded into mounting head 27 and positioned at a specific location with respect to the outer ends of slots 28.

After completing the connections of the primary and secondary leads to the respective prongs, the transformer assembly 16 is applied to base plate 31 of case 11 by inserting prongs 12 through openings 32 in base later 31. As the transformer is pressed all of the way home, T-shaped formation 33, molded on the inner face of base plate 31, telescopes edgewise into a mating-shaped slot 34 formed in mounting head 27. During such telescoping movement, flat panel 36 is moved to a position to block off or extend across the open ends of slots 28 to prevent any edgewise movement of the prongs in the slots. This secures the bobbin, and hence the transformer and prongs 12 to the base plate 31 with relative rigidity against movement in any direction except the reverse or detelescopic direction (which is later prevented by application of cover 41).

The T-formation 33 is braced by panel 36, molded with the remainder so that the T-formation is quite rigid. Since the T-formation 33 and panel 36 are integral with each other and effectively produce a generally I-shaped formation, even twisting movements between transformer 16 and base 31 are resisted or prevented. The panel 36, as best seen in FIG. 1, lies immediately above base portions or shanks 12' of plug-in prongs 12 thereby clamping them firmly within L-shaped recesses 28. Also, portions of mounting head 27 also extend under the panel 36 and substantially in contact with it, thereby contributing to the firmness or rigidity with which the transformer is held with respect to base 31.

In such an assembled condition, the prongs are held in a fixed position with respect to bobbin 26 and base plate 31. Stated another way, T-shaped slot 34 and T-shaped formation 33 define interlocking formations between the mounting head and the base to prevent any movement of transformer 16 with respect to base plate 31 in the assembled condition and this motion preventing mechanism is assisted by the flat rigid panel which engages a surface of mounting head 27. The other interlocking formations or interlocking means between mounting head 27 and prongs 12 consists of the L-shaped slots 28 and the corresponding L-shaped shanks 12' on prongs 12. These interlocking formations prevent any endwise or longitudinal movement of prongs 12 with respect to slots 28. Any edgewise movement of prongs 12 with respect to slots 28 is prevented by the base plate which extends across the open ends of the slots and retains the prongs within the slots. Thus, prongs 12, transformer 16 and base 31 are held in a fixed position relative to each other simply by the particular configuration of the various interlocking formations between the respective parts.

Bobbin 26 also has recesses 38 located in flanges 46 into which may be inserted connection studs 39. As will be observed in FIG. 1, the flanges 46 of the bobbin rest against base plate 31 so that rocking of the transformer is firmly prevented. Stated another way, the radially extending flanges 46 of the bobbin, which are spaced from mounting head 27, engage base plate 31 to further rigidify the bobbin with respect to the base.

As illustrated in FIG. 2 there may be four recesses 38 for prongs at the four corners of the bobbin. These would be used as illustrated in FIG. 2 for a full-wave charger. It may be desirable to provide an intermediate recess 38 along one end of the bobbin, as seen in FIG. 4, for greatest convenience when only one diode is to be used.

Although any shape of connection stud 39 may be used, the shape shown with upwardly opening slots is preferred. With automatic production, the mechanical arm can pick-up the desired component off a carrying tape and lay it in and bridging between the proper two slotted studs 39. The barred end of the wires of cord 13 and of the secondary coil 19 are also laid in their respective pairs of slotted studs 39. Then the two arms forming each slot can be crimped together to hold the component in place and even to complete the connections thereto if this form of connection is chosen by the manufacturer.

To complete the assembly, case 11 also consists of a bowl-shaped cover 41 which is slipped over the transformer and around an upstanding rim 42 formed on the base plate 31. Cement or solvent is applied before this assembly to cement or weld the cover 41 to the base plate 31. The cover 41 is provided with posts 43 projecting from the front wall of the cover rearwardly the appropriate distance for bearing on the core structure of the transformer (most likely the clmap 17) for holding the transformer firmly in place against any detelescopic movement, i.e., against any movement in the reverse direction to the insertion movement of the T-shaped formation and T-shaped slot.

Some transformers have thicker cores than others. To accommodate two or more sizes, the posts 43 are made of a form such that by substituting pins or other inserts within the mold, two or more lengths of posts may be made very conveniently. The posts are provided with bracing webs 48 connecting them to end walls of the cover 41, but these bracing webs extend only for the minimum length of the posts 43. The varying extra length is so short that the bracing is not needed.

A slightly modified form of cooperating means between the mounting head and the plug-in prongs is disclosed in FIGS. 5 and 6. Again, as in the previous embodiment, the cooperating means prevents endwise or longitudinal movement of the prongs with respect to the elongated slots. Since most of the structure of the modified form of the invention is identical to that described above in connection with FIGS. 1 through 4, only the differences will be discussed in detail.

In the embodiment illustrated in FIGS. 5 and 6, the interconnection between the prongs and the mounting head is simplified and results in the use of less metal (such as brass) for the prongs. In the embodiment illustrated in FIGS. 5 and 6, mounting head **27*a* of bobbin 26*a* has elongated planar slots 50 extending from one edge thereof. Flat elongated prongs 12*a* are inserted edgewise into the slots and have edges in engagement with the bases of the slots when the prongs are in the fully engaged position. In the embodiment illustrated in FIGS. 5 and 6, the shanks 60 of prongs 12*a* each have a recess 61 extending from one edge adjacent the inner end thereof. In addition, each slot 50 has a projection 62 extending from the base thereof which projection is received into recess 61 when the prong, particularly shank 60, is fully inserted into the slot. Thus, recess 61 and projection 60** define the interlocking means between the mounting head and the prong to prevent longitudinal or endwise movement of the prong with respect to the mounting head.

The assembly and operation of the voltage-reducing power pack utilizing the bobbin **26*a* illustrated in FIGS. 5 and 6 is identical to the assembly of the embodiment illustrated in FIGS. 1–4.** Thus, a detailed description thereof does not appear to be necessary.

As can be appreciated from the above description, the unique interlocking arrangement between the various parts greatly simplifies the time required for assembling units and virtually all of the steps can be performed with machines rather than being done by hand.

What is claimed is:

1. A voltage-reducing power pack including a case with a base plate having openings therein; a transformer in the case having a bobbin molded of one piece with a mounting head, said mounting head having a pair of spaced, parallel elongated slots therein; a pair of plug-in prongs having shanks respectively received edgewise in said slots; interlocking means between said mounting head and plug-in prongs preventing endwise movement of said prongs when in said slots; sturdy interlocking formations on said base plate and mounting head telescoping together as the plug-in prongs are threaded through said openings in said base plate to project normally for rigidifying the bobbin and the prongs with respect to the base plate; panel means extending from said base plate across open ends of said slots to retain said prongs in said slots; and a cover secured to the base plate and having formations thereon which engage the transformer structure in the direction of its insertion into the base plate to prevent detelescopic movement of said interlocking formations.

2. A voltage-reducing power pack as defined in claim 1, in which said bobbin has radially extending flange means spaced from said mounting head, said flange means engaging said base plate to further rigidify said bobbin with respect to said base plate.

3. A voltage-reducing power pack as defined in claim 2, in which said interlocking formations include a T-shaped projection on one of the base plate and mounting head and a T-shaped slot on the other of said base plate and mounting head.

4. A voltage-reducing power pack as defined in claim 1, in which said interlocking means includes a projection in each of said slots intermediate opposite ends with said shanks having recesses extending from one edge thereof and receiving respective projections during edgewise movement of said shanks into said slots.

5. A voltage-reducing power pack as defined in claim 1, in which said slots are L-shaped and said shanks are correspondingly L-shaped to define said interlocking means.

6. A voltage-reducing power pack as defined in claim 1, in which said panel means is a planar flange integral with said base plate and said interlocking formations include a second flange parallel to said first flange and a web extending between said flanges and integral therewith with said mounting head having a T-shaped slot receiving said second flange and web, said first flange extending along one edge of said mounting head to lock said prongs in said slots.

7. An assembly for a voltage-reducing power pack including a base plate having openings therein, and a transformer mounted thereon having a bobbin molded of one piece with a mounting head, the mounting head having elongated slots therein, plug-in prongs having shanks received edgewise in said slots, interlocking means between said mounting head and shanks preventing longitudinal movement of said shanks in said elongated slots; interlocking T-shaped formations including a projecting formation on the base plate and slot on the mounting head, the projecting formation on the base plate including two parallel flanges connected by a bracing web extending between them, a first one of the flanges closing the slots to hold the prongs therein and the other flange holding the mounting head against the first flange with a snug fit retaining the bobbin in position on the base plate.

8. An assembly according to claim 7, in which the base plate is essentially flat, leaving the transformer well exposed for manufacturing steps thereon until a deep cover is applied.

9. An assembly according to claim 7, in which said slots are angular and said shanks having a mating angular configuration to define said interlocking means.

10. An assembly according to claim 7, in which said slots have projections intermediate opposite ends and said shanks have recesses extending from one edge and receiving said projections to define said interlocking means.

* * * * *

UNITED STATES PATENT OFFICE

CERTIFICATE OF CORRECTION

Patent No. 4,028,654 Dated June 7, 1977

Inventor(s) Robert G. Bullard et al.

It is certified that error appears in the above-identified patent and that said Letters Patent are hereby corrected as shown below:

Column 3, line 10, "therefore" should read -- heretofore --.

Column 5, line 21, "clmap" should read -- clamp --.

Signed and Sealed this

*Eighth* Day of *November 1977*

[SEAL]

*Attest:*

RUTH C. MASON
*Attesting Officer*

LUTRELLE F. PARKER
*Acting Commissioner of Patents and Trademarks*